US005940912A

United States Patent [19]

Keselman et al.

[11] Patent Number: 5,940,912

[45] Date of Patent: Aug. 24, 1999

[54] SURGICAL ARMBOARD

[75] Inventors: Yury Keselman, Beachwood; Richard Navarro, Strongsville, both of Ohio

[73] Assignee: Amatech Corporation, Acton, Mass.

[21] Appl. No.: 08/975,143

[22] Filed: Nov. 20, 1997

Related U.S. Application Data

[60] Provisional application No. 60/033,341, Nov. 21, 1996.

[51] Int. Cl.[6] ..... A61G 13/12; A61G 13/00

[52] U.S. Cl. ..... 5/623; 5/646; 297/411.35

[58] Field of Search ..... 5/623, 624, 621, 5/646, 647; 297/411.23, 411.35, 411.38; 248/118

[56] References Cited

U.S. PATENT DOCUMENTS

| | | | |
|---|---|---|---|
| 2,605,152 | 7/1952 | Krewson . | |
| 2,658,211 | 11/1953 | Bendersky | 5/623 |
| 2,819,406 | 1/1958 | Frecking, Jr. et al. . | |
| 3,046,072 | 7/1962 | Douglass, Jr. et al. | 5/623 |
| 3,581,088 | 5/1971 | Eagels . | |
| 3,614,085 | 10/1971 | Cunningham | 297/411.38 |
| 4,766,892 | 8/1988 | Kreitman | 5/623 |
| 4,836,113 | 6/1989 | Waddell et al. | 5/507.1 |
| 4,858,903 | 8/1989 | Tari et al. | 5/623 |
| 5,038,434 | 8/1991 | Navarrettte | 5/507.1 |
| 5,135,210 | 8/1992 | Michelson | 5/623 |
| 5,226,070 | 7/1993 | Ariba et al. | 378/208 |
| 5,287,575 | 2/1994 | Allen et al. | 5/623 |
| 5,359,741 | 11/1994 | Lang | 5/507.1 |
| 5,362,021 | 11/1994 | Phillips | 5/507.1 |

FOREIGN PATENT DOCUMENTS

| | | | |
|---|---|---|---|
| 1256977 | 12/1971 | United Kingdom | 297/411.38 |

*Primary Examiner*—Alexander Grosz
*Attorney, Agent, or Firm*—Pearne, Gordon, McCoy & Granger LLP

[57] ABSTRACT

An armboard assembly that is X-ray translucent and includes a board pivotably connected to a latching assembly. A locking assembly, which is disposable inside the board, is connected to the latching assembly and the board. The locking assembly is operable to selectively secure the board from movement relative to the latching assembly. The board defines a handle opening within which is disposed a grip for controlling the locking assembly.

22 Claims, 5 Drawing Sheets

SURGICAL ARMBOARD

CROSS-REFERENCE TO RELATED APPLICATION

This application claims the benefit of U.S. Provisional Application No. 60/033,341, filed Nov. 21, 1996.

BACKGROUND OF THE INVENTION

The present invention generally relates to limb-supporting boards and, more particularly, to a movable armboard that may be attached to a table for supporting a human body.

It is known to provide a limb-supporting board, such as an arm board, that may be movably attached to a table for supporting a human body, such as a surgical table or an X-ray table. Such a table typically has standardized side rails for receiving attachments.

A conventional movable armboard includes an elongated planar member for supporting an arm during a medical procedure. The planar member is pivotally connected to a mounting bracket that is adapted for releasable attachment to one of the side rails of the table. The planar member is connected to the mounting bracket by a pin so as to be pivotable through a plurality of angular positions extending along an arc of 180° or less. Since it is desirable to secure the arm from movement during the medical procedure, a locking mechanism is provided to selectively secure the planar member in one of the angular positions.

A typical locking mechanism for an armboard includes a gear wheel and an engagement bar. An example of such a locking mechanism is shown in U.S. Pat. No. 5,135,210 to Michelson, which is incorporated herein by reference. In such a locking mechanism, the gear wheel is secured to the mounting bracket and has a plurality of teeth. The engagement bar includes an inner end with a pointed tip and an outer end with a handle secured thereto. The engagement bar is slidably attached to a bottom side of the planar member by U-shaped clamps so as to be longitudinally disposed along the length of the support member.

The engagement bar is slidable along the bottom side so as to permit the tip to be selectively inserted between the teeth of the gear wheel. When the engagement bar is pulled away from the gear wheel, the tip is removed from between the teeth, thereby permitting the planar member to move relative to the mounting bracket. When the engagement bar is pushed toward the gear wheel, the tip is inserted between the teeth, thereby preventing the planar member from moving relative to the mounting bracket.

Since the gear wheel is disposed on the exterior of the armboard, the gear wheel is often damaged if the armboard is dropped onto a floor. In addition, the gear wheel is often contacted by medical personnel working around the table. During such contact, the teeth of the gear wheel may snag and thereby damage clothing of the medical personnel. Moreover, dirt and other contaminants often collects between the teeth and is not easily removed, thereby making the armboard difficult to clean.

Since the handle of the locking mechanism is also located on the bottom side of the armboard, the handle is also often damaged if the armboard is dropped onto a floor. The location of the handle on the bottom side of the armboard also makes the handle difficult to reach during a medical procedure, which is ergonomically undesirable.

Based upon the foregoing, there is a need in the art for a movable armboard that does not have an exterior gear wheel and does not have a manipulating handle located on a bottom side of the armboard. The present invention is directed to such a movable armboard.

SUMMARY OF THE INVENTION

It therefore would be desirable, and is an advantage of the present invention, to provide a board assembly that does not have an exterior gear wheel and does not have a manipulating handle located on a bottom side of the armboard. In accordance with the present invention, the board assembly includes a board pivotably connected to a latching assembly, which is adapted for releasable attachment to a table.

In one embodiment, the board assembly includes a rod and an indexing wheel. The indexing wheel is disposed within an interior passage of the board and is connected to the latching assembly. The rod is movably disposed inside the board and has an inner end. The rod is movable between an engaged position, wherein the inner end of the rod engages the indexing wheel so as to prevent movement of the board relative to the latching assembly, and a disengaged position, wherein the inner end of the rod is spaced from the indexing wheel so as to permit movement of the board relative to the latching assembly.

In another embodiment, the board defines a hand opening and the armboard assembly includes a locking assembly connected to the latching assembly and the board. The locking assembly is operable to selectively secure the board from movement relative to the latching assembly. A handle is operatively connected to the locking assembly. The handle is disposed inside the board and is accessible through the hand opening. The handle is movable between a locking position, wherein the locking assembly is activated, and an unlocking position, wherein the locking assembly is deactivated.

In still another embodiment, the armboard assembly includes a lock device connected between the latching assembly and the board. The lock device is selectively operable in a locking mode and an unlocking mode. When in the locking mode, the lock device has a fixed length so as to prevent movement of the board relative to the latching assembly. When in the unlocking mode, the locking device has an adjustable length so as to permit movement of the board relative to the latching assembly.

BRIEF DESCRIPTION OF THE DRAWINGS

The features, aspects, and advantages of the present invention will become better understood with regard to the following description, appended claims, and accompanying drawings where:

DESCRIPTION OF THE PREFERRED EMBODIMENTS

Figure 1:
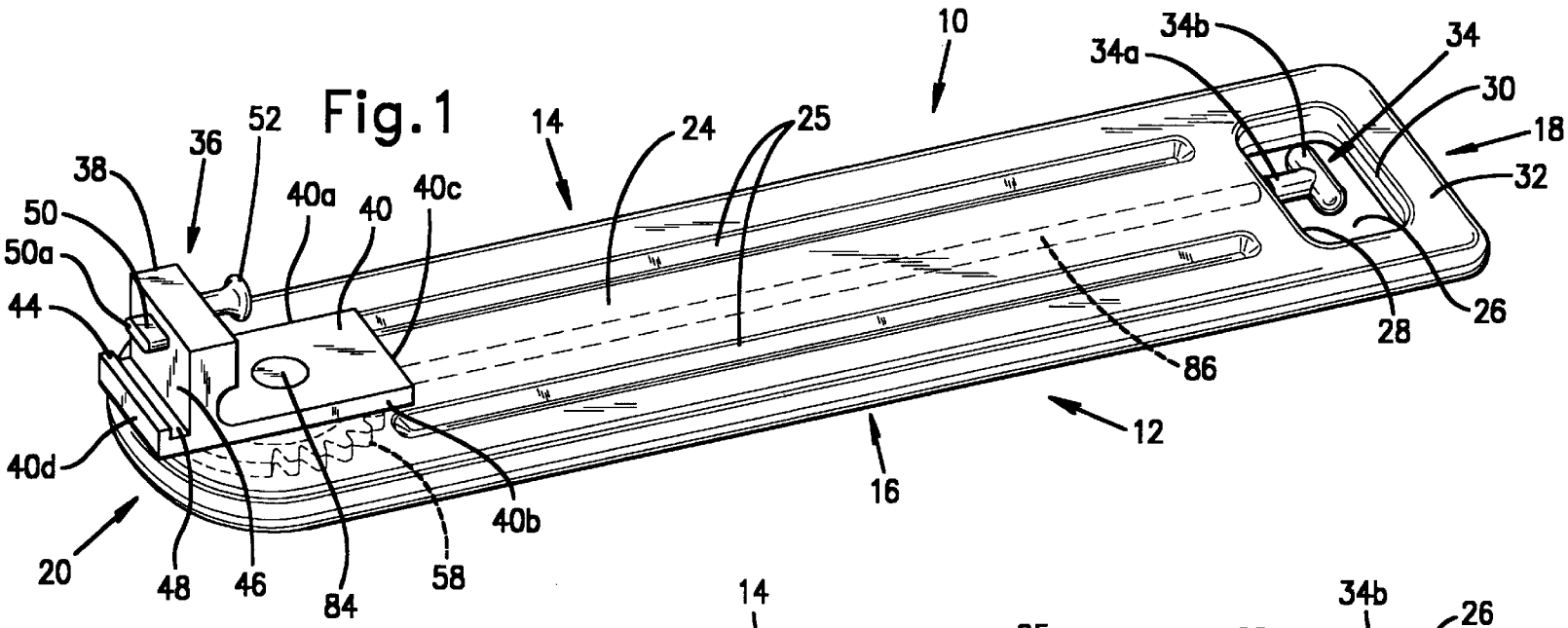
FIG. 1 is a perspective view of the bottom of a first armboard assembly having a latching assembly.
Figure 2:
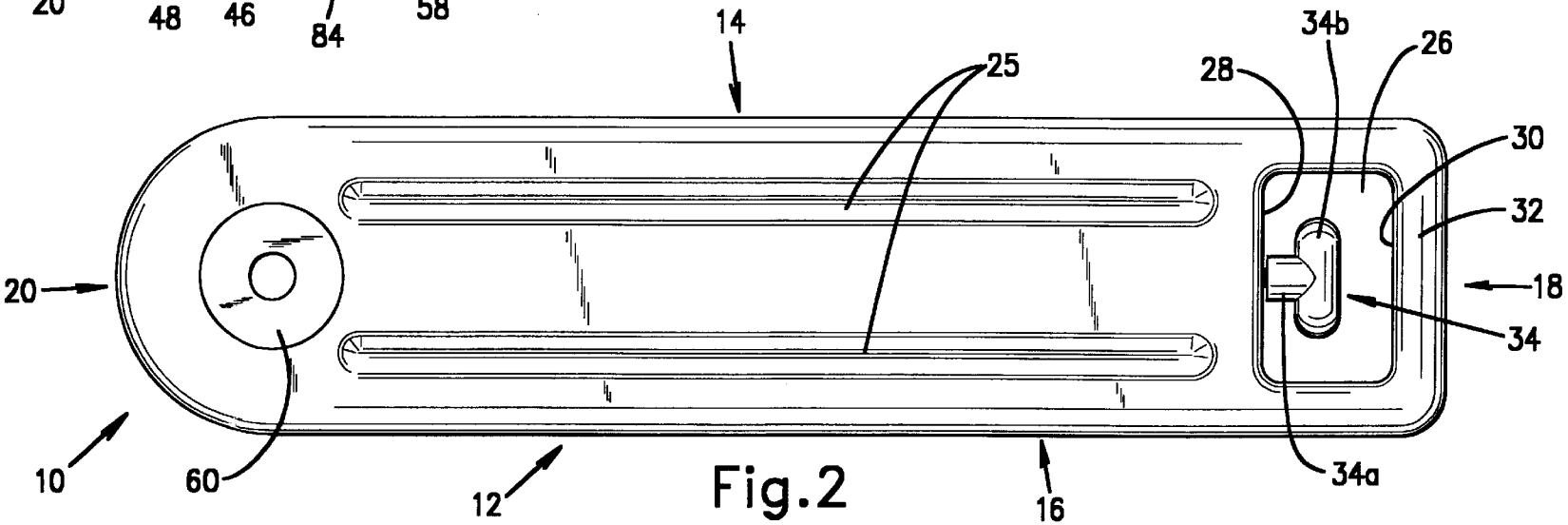
FIG. 2 is a bottom view of the first armboard assembly with the latching assembly removed.
Figures 3, 4, 5, 6:
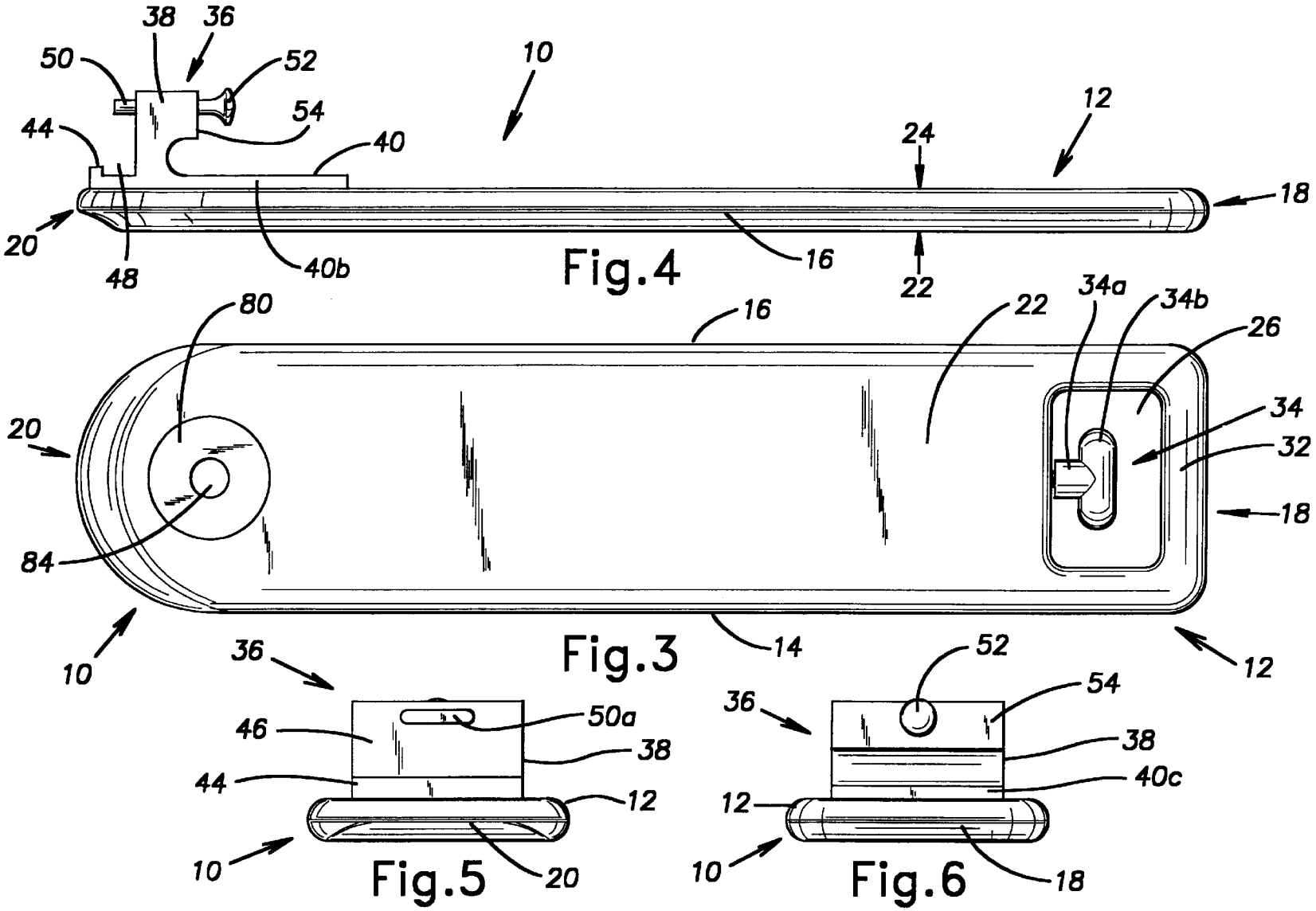
FIG. 3 is a top view of the first armboard assembly.
FIG. 4 is a side view of the first armboard assembly.
FIG. 5 is an end view of the first armboard assembly.
FIG. 6 is another end view of the first armboard assembly.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIGS. 1–6, there is shown a first armboard assembly 10 constructed in accordance with a first embodiment of the present invention. The first armboard assembly 10 includes a generally rectangular board 12 constructed so as to be generally transparent or translucent to X-rays through its thickness. Accordingly, the board 12 is constructed from material that is generally transparent or translucent to X-rays, such as plastic. Preferably, the board 12 has a composite structure comprising a rigid outer shell and a foamed interior filling. The outer shell is preferably composed of a hard plastic, such as polyethylene, or polypropylene. The interior filling is preferably composed of a foamed plastic, such as polyurethane foam.

The board 12 has opposing first and second sides 14, 16 and opposing first and second ends 18, 20. The board 12 also provides a top surface 22 (shown in FIG. 3) and a bottom surface 24. The terms "top", "bottom", "above", "below", "upwardly", and "downwardly" as used herein generally refer to the orientation of the board 12 when attached to a table (not shown), or otherwise placed in use.

Preferably, the first and second sides 14, 16 are parallel to each other and have rounded edges. The first and second sides 14, 16 extend between the first and second ends 18, 20 of the board 12. Preferably, the first end 18 of the board 12 is generally rectangular with rounded corners and edges, while the second end 20 of the board 12 is rounded or arcuate. More preferably, the second end 20 is semicircular and has a peripheral edge that is beveled or otherwise streamlined. This configuration minimizes interference from the board 12 when it is rotated, as will be described in more detail later.

Preferably, the top surface 22 of the board 12 is relatively smooth and free from surface irregularities, while the bottom surface 24 of the board 12 has one or more channels 25 formed therein. The channels 25 extend between the first and second ends 18, 20 of the board 12. Preferably, the channels 25 extend along most of the length of the board 12. The channels 25 form inwardly-directed ribs, which help strengthen the board 12 and increase its rigidity.

The board 12 may be provided with anchor devices (not shown) for attaching supplemental support or restraining straps (not shown) to the board 12. Anchor devices which may be used include VELCRO strips secured by adhesive to the board 12. Preferably, the anchor devices are disposed along the bottom surface 24 of the board 12.

A hand opening 26 is formed in the board 12, toward the first end 18. The hand opening 26 is generally rectangular and is partially defined by opposing inner and outer interior walls 28, 30. The hand opening 26 provides the first end 18 of the board 12 with a bar portion 32 that may function as a handle for the board 12. A T-shaped grip 34 is disposed in the hand opening 26. The grip 34 includes a base 34*a* joined to the center of a rounded bar 34*b*.

The grip 34 is positioned in the hand opening 26 so as to not extend above the plane of the top surface 22, or below the plane of the bottom surface 24. As will be described in more detail later, the grip 34 is movable between a locking position, wherein the grip 34 is proximate to the inner interior wall 28, and an unlocking position, wherein the grip 34 is distal to the inner interior wall 28. The grip 34 is spring-biased to the locking position. The hand opening 26 is sized to permit the grip 34 to move between the locking and unlocking positions.

Although not shown, an enlarged main passage is formed in the board 12, toward the second end 20. The main passage extends between top and bottom openings (not shown) formed in the top and bottom surfaces 22, 24, respectively. Preferably, the top and bottom openings are slightly larger than the main passage so as to form circular top and bottom shoulder surfaces (not shown) around top and bottom ends of the main passage. An elongated passage (not shown) extends through the board 12, between the main passage and the hand opening 26.

When the first armboard assembly 10 is used to support an arm during a medical procedure, the arm is positioned in a work zone on the board 12. The work zone extends between the hand opening 26 of the board 12 and the main passage. As will be described in more detail later, the work zone is translucent to X-rays.

A latching assembly 36 is pivotally connected to the board 12, over the main passage in the board 12. The latching assembly 36 is preferably disposed on the bottom surface 24 of the board 12 and comprises a mounting block 38 extending downwardly at approximately a right angle from a base plate 40. The latching assembly 36 is composed of a strong and rigid material. Since the latching assembly 36 is located outside of the work zone, the latching assembly 36 may be composed of a strong and rigid material that is not translucent to X-rays, such as a metal, preferably steel.

The base plate 40 is generally rectangular and includes first and second side edges 40*a*, 40*b*, and inner and outer ends 40*c*, 40*d*. A threaded bore 42 (shown in FIG. 7) extends through the base plate 40. A retaining lip 44 extends downwardly from the outer end 40*d*. The retaining lip 44 and an outer wall 46 of the mounting block 38 cooperate with the base plate 40 to define a mounting channel 48 for receiving a top portion of a side rail (not shown) of a table (not shown).

A plunger 50 slidably extends through a passage in the mounting block 38. The plunger 50 includes a free outer end 50*a* and an inner end 50*b* (shown in FIG. 7) connected by a threaded shaft 51 (shown in FIG. 7) to a knob 52 disposed proximate to an inner wall 54 (shown best in FIG. 6) of the mounting block 38. The plunger 50 is movable between a retracted position, wherein the outer end 50*a* of the plunger 50 is disposed substantially flush with the outer wall 46 of the mounting block 38, and an extended position (shown in FIGS. 1 and 4), wherein the outer end 50*a* of the plunger 50 is spaced outwardly from the outer wall 46. The plunger 50 is spring biased toward the extended position. The plunger 50 may be moved to the retracted position by pulling the knob 52 toward the first end 18 of the board 12 and overcoming the spring bias.

The first armboard assembly 10 may be mounted to the side rail of the table by positioning the free end 50*a* of the plunger 50 against a lateral portion of the side rail. The first armboard assembly 10 is then moved inward, toward the side rail, thereby causing the side rail to move the plunger 50 to the retracted position. The movement of the plunger 50 to the retracted position permits the latching assembly 36 to move downward, thereby causing the top portion of the side rail to move into the mounting channel 48 and the plunger 50 to move below the side rail. After the plunger 50 moves below the side rail, the plunger 50 springs back to the extended position, thereby trapping the side rail between the plunger 50 and the base plate 40 in the mounting channel 48 so as to releasably secure the latching assembly 36 to the side rail. With the latching assembly 36 so secured to the side rail, the side rail supports the latching assembly 36 and, thus, the first armboard assembly 10.

It should be appreciated that the first armboard assembly 10 may be removed from the side rail by moving the plunger 50 to the retracted position and lifting the first armboard assembly 10 off the side rail.

Figure 7:
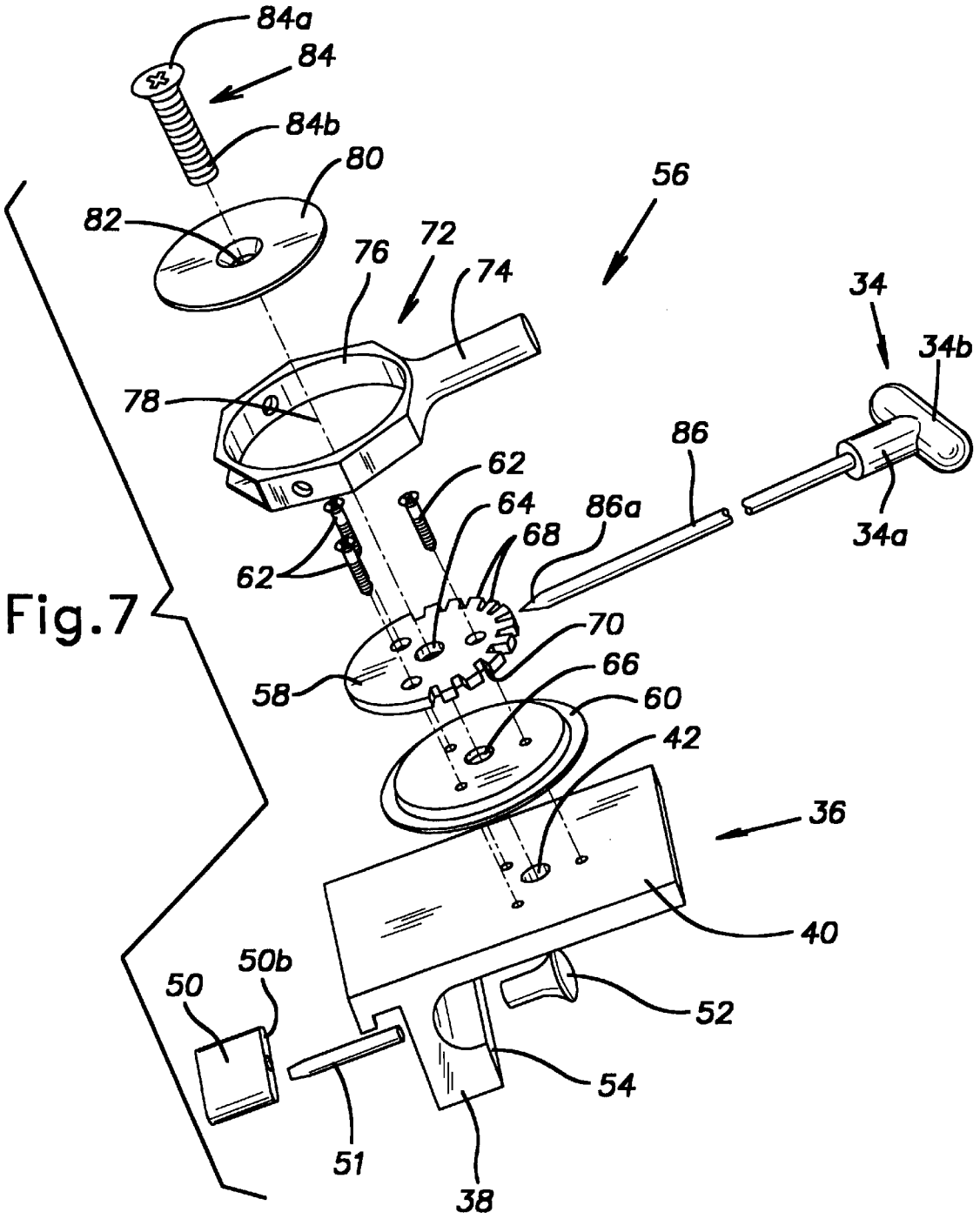
FIG. 7 is an exploded view of the latching assembly and an indexing assembly of the first armboard assembly.

Referring now to FIG. 7 there is shown an exploded view of an indexing assembly 56 connected to the latching assembly 36. The description of the indexing assembly 56 set forth below, however, relates to the indexing assembly 56 when it is assembled and mounted in the board 12.

The indexing assembly 56 includes an indexing wheel 58 disposed on top of a bottom mounting disk 60, which is, in turn, disposed on top of the base plate 40 of the latching assembly 36. The indexing wheel 58 and the bottom mounting disk 60 are secured to the base plate 40 by fastening means, such as screws 62. A bore 64 extends through the center of the indexing wheel 58 and is aligned with a bore 66 extending through the bottom mounting disk 60. The indexing wheel 58 is generally circular and has a circumferential edge defining a plurality of teeth 68 separated by gaps 70. The teeth 60 extend along approximately half of the circumference of the indexing wheel 58. The indexing wheel 58 is composed of a strong and rigid material so the teeth 68 cannot be easily broken off or deformed.

The indexing assembly 56 further includes a guide frame 72 having a guide tube 74 extending from a guide ring 76. The guide ring 76 defines an inner void 78 and has a diameter slightly smaller than the diameter of the main passage in the board 12. A passage (not shown) in the guide tube 74 extends through the guide ring 76 and opens into the inner void 78. The guide frame 72 is disposed inside the main passage of the board 12 such that the guide ring 76 is disposed adjacent a circular interior wall (not shown) defining the main passage, and such that the guide tube 74 extends into the elongated passage in the board 12.

When the latching assembly 36 is disposed adjacent to the bottom surface 24 of the board, the indexing wheel 58 is disposed inside the interior void 78 of the guide frame 72. The teeth 68 of the indexing wheel 58 are directed toward the first end 18 of the board 12 and are aligned with the guide tube 74. In addition, the bottom mounting disk 60 is disposed in the bottom opening of the board 12 and rests against the bottom shoulder surface. With the bottom mounting disk 60 so positioned, the bottom mounting disk 60 is disposed substantially flush with the bottom surface 24.

A top mounting disk 80 is disposed in the top opening of the board 12 and is secured against the top shoulder surface so as to prevent movement of the top mounting disk 80 relative to the board 12. With the top mounting disk 80 so positioned, the top mounting disk 80 is disposed substantially flush with the top surface 22. A frustoconical passage 82 extends through the top mounting disk 80. The passage 82 has an enlarged outer opening and a diminished inner opening.

A pivot bolt 84 is provided for pivotally connecting the board 12 to the latching assembly 36. The pivot bolt 84 has a frustoconical head 84*a* joined to a threaded body 84*b*. The head 84*a* is disposed in the passage 82 so as to be flush with the top mounting disk 80. The head 84*a*, however, cannot pass through the passage 82. The body 84*b* of the pivot bolt 84 extends through the bores 64, 66 in the indexing wheel 58 and the bottom mounting disk 60, and is threadably received in the bore 42 of the base plate 40 so as to be fixed thereto. In this manner, the board 12 is trapped between the top mounting disk 80 and the latching assembly 36, and is pivotable about the pivot bolt 84.

The board 12 is pivotable 360° about the pivot bolt 84. The board 12, however, only needs to pivot 180° between a first position, wherein the first side 14 of the board 12 is disposed substantially parallel with the outer end 40*d* of the base plate 40, and a second position, wherein the second side 16 of the board 12 is disposed substantially parallel with the outer end 40*d* of the base plate 40. Midway between the first and second positions is a center position (shown in FIG. 1), wherein the first and second side edges 40*a*, 40*b* of the base plate 40 are disposed substantially parallel to the first and second sides 14, 16 of the board 12 and the outer end 40*d* of the base plate 40 is directed toward the second end 20 of the board 12. When the first armboard assembly 10 is mounted to the side rail of the table and the board 12 is moved to the center position, the board 12 extends perpendicular from the side rail and the table.

Since the indexing wheel 58, the top and bottom mounting disks 80, 60, and the pivot bolt 84 are located outside the work zone, they may be composed of a material that is not translucent to X-rays, such as steel.

When the board 12 is rotated about the pivot bolt 84, the board 12 rotates relative to the indexing wheel 58. A pointed dog end 86*a* of a rod 86 is used to engage the teeth 68 of the indexing wheel 58 to prevent the board 12 from rotating relative to the indexing wheel 58 and, thus, the latching assembly 36. The dog end 86*a* of the rod 86 is disposed inside the inner void 78 of the guide frame 72, proximate the teeth 68 of the indexing wheel 58.

The rod 86 is slidably secured within the board 12 and extends from the dog end 86*a* to a mounting end secured to the base 34*a* of the grip 34. Between the dog end 86*a* and the mounting end, the rod 86 passes through the guide tube 74 of the guide frame 72 and the elongated passage in the board 12. The rod 86 is composed of a rigid material that is generally transparent or translucent to X-rays. Preferably, the rigid material is a hard plastic, such as nylon, polyethylene, or acrylonitrile-butadiene-styrene (ABS) plastic.

Since the rod 86 is connected to the grip 34, movement of the grip 34 controls movement of the rod 86 and, thus, its dog end 86*a*. When the grip 34 is moved to the locking position, the dog end 86*a* moves toward the second end 20 of the board 12 and is inserted into the gap 70 between a pair of the teeth 68, thereby preventing movement of the board 12 relative to the indexing wheel 58. When the grip 34 is moved to the unlocking position, the dog end 86*a* moves toward the first end 18 of the board 12 and is removed from the gap 70 between the teeth 68, thereby permitting movement of the board 12 relative to the indexing wheel 58.

As can be appreciated from the foregoing description, the grip 34 may be manipulated to selectively lock the board 12 in one of a plurality of angular positions relative to the latching assembly 36. To do so, the grip 34 is first moved against its spring bias to the unlocking position so as to remove the dog end 86*a* from the gap 70 between a pair of the teeth 68. The board 12 is then rotated to a selected angular position and the grip 34 released for movement to the locking position. As the grip 34 moves to the locking position, the dog end 86*a* moves into the gap 70 between a second pair of the teeth 68, thereby locking the board 12 in the selected angular position.

It should be appreciated that the angular positions in which the board 12 may be locked correspond to the gaps 70 between the teeth 68 of the indexing wheel 58. Thus, the range of the angular positions extends 180° between the first and second positions of the board. Moreover, the number of angular positions is limited to the number of gaps 70 in the indexing wheel 58.

The construction of the first armboard assembly 10 with the grip 34 inside the hand opening 26 permits the board 12 to be positioned with one hand. To do so, an operator grabs the bar portion 32 of the first end 18 with a hand while clasping the grip 34 between two fingers of his/her hand. The operator then bends his/her fingers toward the bar portion 32 to move the grip 34 to the unlocking position, thereby releasing the dog end 86*a* from engagement with the indexing wheel 58. The operator then moves the board 12 with his/her hand to a desired angular position, while holding the grip 34 in the unlocking position with his/her fingers. Once the board 12 is in the desired angular position, the operator releases the grip 34 from his/her fingers to permit the grip 34 to move back to the locking position, thereby engaging the dog end 86*a* with the indexing wheel 58 and locking the board in position.

It should be appreciated from the foregoing description of the first armboard assembly 10 that the first armboard assembly 10 provides numerous benefits. The location of the indexing wheel 58 and the rod 86 inside the board 12 prevents the indexing wheel 58 and the rod 86 from being damaged if the first armboard assembly 10 is dropped onto a floor. This location also prevents the indexing wheel 58 and the rod 86 from snagging the clothing of medical personnel working around the table. In addition, the location makes the first armboard assembly 10 easier to clean by eliminating areas on the exterior of the first armboard assembly 10 that would otherwise collect direct and be difficult to clean.

The positioning of the grip 34 inside the hand opening 26 permits the board 12 to be moved with only one hand, which is ergonomically desirable. In addition, this positioning protects the grip 34 from being damaged if the first armboard assembly 10 is dropped.

The construction of the board 12 and the rod 86 from materials translucent to X-rays makes the work zone of the board 12 translucent to X-rays. Since an arm being supported by the first armboard assembly 10 will be disposed within the work zone, the first armboard assembly 10 is, in operation, translucent to X-rays.

Figure 8:
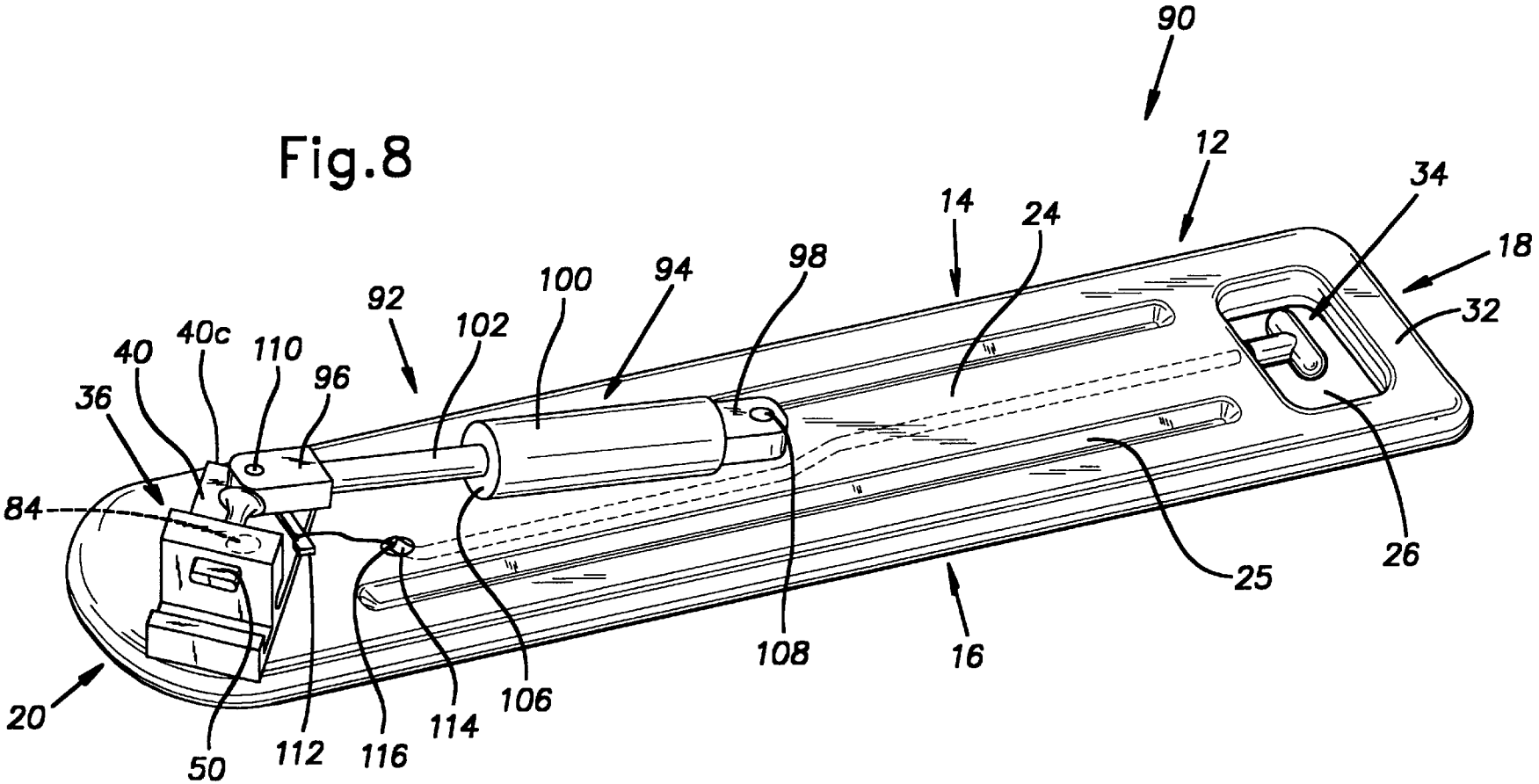
FIG. 8 is a perspective view of the bottom of a second armboard assembly.
Figure 9:
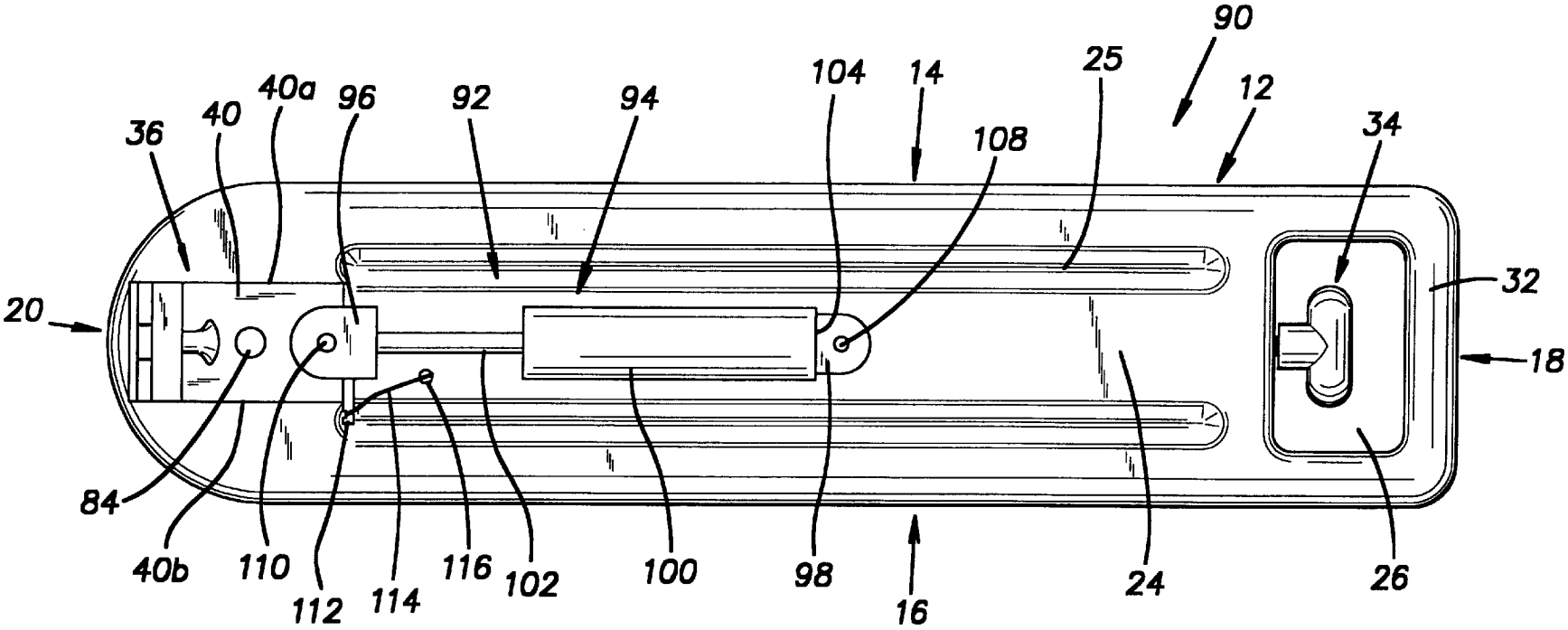
FIG. 9 is a bottom view of the second armboard assembly.

Referring now to FIGS. 8 and 9, there is shown a second armboard assembly 90 constructed in accordance with a second embodiment of the present invention. The second armboard assembly 90 has essentially the same construction as the first armboard assembly 10, except for the differences to be hereinafter described. In the second armboard assembly 90, the indexing wheel 58 and the rod 86 are not present. Instead, the second armboard assembly 90 has a locking-piston assembly 92 disposed on the bottom surface 24 of the board 12. The locking-piston assembly 92 includes a locking piston 94, a coupling 96, and a mount 98.

The locking piston 94 includes a main cylinder 100 and an arm member 102. The main cylinder 100 has a first end wall 104 secured to the mount 98 and a second end wall 106 through which the arm member 102 extends. The mount 98 is pivotably secured to the board 12 by a pivot shaft 108. Although not shown, the pivot shaft 108 may extend through annular mounting disks disposed within the top and bottom surfaces 22, 24 so as to better disperse forces exerted through the pivot shaft 108.

An inner end of the arm member 102 is connected to a piston element (not shown) movably disposed inside the main cylinder 100, while an outer end of the arm member 102 is secured to the coupling 96. The coupling 96 is pivotally connected to the base plate 40 by a pivot pin 110. The pivot pin 110 is spaced from the pivot bolt 84 so as to be closer to the inner end 40*c* of the base plate 40. Between the first and second side edges 40*a*, 40*b* of the base plate 40, however, the pivot pin 110 is aligned with the pivot bolt 84.

The arm member 102 is telescopically movable relative to the main cylinder 100 between a retracted position, wherein the locking-piston assembly 92 has a minimum length between the pivot pin 110 and the pivot shaft 108, and an extended position, wherein the locking-piston assembly 92 has a maximum length between the pivot pin 110 and the pivot shaft 108. The minimum length of the locking-piston assembly 92 corresponds to the linear distance between the pivot pin 110 and the pivot shaft 108 when the base plate 40 is in the center position, whereas the maximum length of the locking-piston assembly 92 corresponds to the linear distance between the pivot pin 110 and the pivot shaft 108 when the base plate 40 is in either the first position or the second position. Thus, when the base plate 40 is in the center position (as shown in FIG. 9), the arm member 102 is in the retracted position and the locking-piston assembly 92 is longitudinally disposed along the length of the board 12, i.e., is parallel to the first and second sides of the board 14, 16. Movement of the board 12 from the center position to either the first position or the second position causes the arm member 102 to move to the extended position and the main cylinder 100 to pivot so as to be disposed at an angle to the length of the board 12.

The locking piston 94 is constructed to normally have a fixed length, i.e., the arm member 102 is normally locked in position relative to the main cylinder 100. The locking piston 94, however, is provided with a release mechanism (not shown) that may be activated to provide the locking piston 94 with an adjustable length, i.e., to permit the arm member 102 to move relative to the main cylinder 100. The release mechanism is activated by a lever 112 extending away from the coupling 96. The lever 112 is movable between a first position, wherein the lever 112 activates the release mechanism, and a second position, wherein the lever 112 deactivates the release mechanism. The lever 112 is biased toward the second position, which is located toward the second end 20 of the board 12.

The lever 112 is connected to the grip 34 by a cable 114. When the grip 34 is moved to the unlocking position, the cable 114 moves the lever 112 to the first position and activates the release mechanism. As a result, the arm member 102 is movable relative to the main cylinder 100, thereby permitting the board 12 to be moved to either the first position or the second position.

The cable 114 is disposed in the elongated passage of the board 12 and extends through an opening 116 in the bottom surface 24 of the board 12. The cable 114 is preferably of the Bowden type and is constructed so as to be generally transparent or translucent to X-rays. Accordingly, the cable 114 may be composed of a nylon wire enclosed in a plastic sheath.

In a manner similar to that in the first armboard assembly 10, the grip 34 may be manipulated to selectively lock the board 12 in one of a plurality of angular positions relative to the latching assembly 36. To do so, the grip 34 is first moved against its spring bias to the unlocking position so as to activate the release mechanism and thereby provide the locking piston 94 with an adjustable length. The board 12 is then rotated to a selected angular position, with the locking piston 94 increasing in length as a result thereof. The grip 34 is then released for movement to the locking position. When the grip 34 moves to the locking position, the release mechanism is deactivated. As a result, the locking piston 94 becomes fixed in length, thereby locking the board 12 in the selected angular position. Unlike in the first armboard assembly 10, the number of angular positions in which the board 12 may be locked is unlimited due to the use of the locking piston 94 instead of the indexing wheel 58.

The locking piston 94 is of a conventional design known to one skilled in the art. The locking piston 94 may be of a gas-charged type or a spring-loaded type. If the locking piston 94 is of the gas-charged type, the arm member 102 is biased toward the retracted position when the release mechanism is activated. Thus, when the release mechanism is activated, the locking piston 94 will automatically move the base plate 40 to the center position without the operator having to physically move the board 12.

An example of a gas-charged locking piston that may be used in the second armboard assembly 90 is sold under the name "Bloc-O-Lift" by Stabilus of Koblenz, Germany. An example of a spring-loaded locking piston that may be used in the second armboard assembly 90 is sold under the name "Mech Lock" by P. L. Porter of Woodland Hills, Calif.

It should be appreciated that instead of being disposed on the bottom surface 24 of the board 12, the locking-piston assembly 92 may be mounted inside the board 12 in a manner similar to the rod 86 and the indexing wheel 58 of the first armboard assembly 10. It should also be appreciated that the position of the locking-piston assembly 92 may be transposed such that the mount 98 is pivotally secured to the base plate 40 of the latching assembly 36 and the coupling 96 is pivotally secured to the board 12.

Although the preferred embodiments of this invention have been shown and described, it should be understood that various modifications and rearrangements of the parts may be resorted to without departing from the scope of the invention as disclosed and claimed herein.

What is claimed is:

1. A board assembly for attachment to a table, said board comprising:

a latching assembly adapted for releasable attachment to the table;

a board pivotably connected to the latching assembly and defining an interior passage, said board having planar top and bottom surfaces and opposing first and second ends;

a handle formed in the board, toward the first end;

an indexing wheel disposed within the interior passage of the board and connected to the latching assembly; and a rod movably disposed inside the board and having an inner end, said rod being movable between an engaged position, wherein the inner end of the rod engages the indexing wheel so as to prevent movement of the board relative to the latching assembly, and a disengaged position, wherein the inner end of the rod is spaced from the indexing wheel so as to permit movement of the board relative to the latching assembly; and a grip connected to the rod and disposed proximate to the handle, said grip being movable between a locking position, wherein the grip moves the inner end of the rod to the engaged position, and an unlocking position, wherein the grip moves the inner end to the disengaged position; and wherein the latching assembly is disposed on the bottom surface of the board and is located toward the second end.

2. The board assembly of claim 1 wherein the rod longitudinally extends along the length of the board.

3. The board assembly of claim 1 wherein the handle is at least partially formed by a hand opening in the board, located toward the first end; and wherein the grip is disposed inside the board and is accessible through the hand opening.

4. The board assembly of claim 3 wherein the board assembly is generally translucent to X-rays between the latching assembly and the hand opening.

5. The board of claim 1 wherein the board and the rod are composed of material generally translucent to X-rays.

6. The board of claim 5 wherein the board and the rod are composed of plastic.

7. A board assembly for attachment to a table, said board comprising:

a latching assembly adapted for releasable attachment to the table;

a board pivotably connected to the latching assembly and defining a hand opening;

a locking assembly connected to the latching assembly and the board, said locking assembly being operable to selectively secure the board from movement relative to the latching assembly; and a handle operatively connected to the locking assembly and disposed inside the board, said handle being accessible through the hand opening and movable between a locking position, wherein the locking assembly is activated, and an unlocking position, wherein the locking assembly is deactivated.

8. The board assembly of claim 7 wherein the board has planar top and bottom surfaces and opposing first and second ends; and wherein the latching assembly is disposed on the bottom surface of the board and is located toward the second end.

9. The board assembly of claim 8 wherein the hand opening is located toward the first end of the board.

10. The board assembly of claim 8 wherein the hand opening extends through the top and bottom surfaces.

11. The board assembly of claim 7 wherein the locking assembly comprises:

an indexing wheel connected to the latching assembly, said indexing wheel defining a plurality of teeth; and a rod movably attached to the board and having a dog end, said rod being movable between an engaged position, wherein the dog end engages the teeth of the indexing wheel so as to prevent movement of the board relative to the latching assembly, and a disengaged position, wherein the dog end is spaced from the teeth of the indexing wheel so as to permit movement of the board relative to the latching assembly.

12. The board assembly of claim 11 wherein the locking assembly is disposed inside the board.

13. The board assembly of claim 7 wherein the locking assembly comprises a lock device connected between the latching assembly and the board, said lock device being selectively operable in a locking mode and an unlocking mode, said device having a fixed length when in the locking mode so as to prevent movement of the board relative to the latching assembly, and said device having an adjustable length when in the unlocking mode so as to permit movement of the board relative to the latching assembly.

14. The board assembly of claim 13 wherein the locking assembly is disposed on an exterior surface of the board.

15. A board assembly for attachment to a table, said board assembly comprising:

a latching assembly adapted for releasable attachment to the table;

a board pivotably connected to the latching assembly;

a lock device connected between the latching assembly and the board, said lock device being selectively operable in a locking mode and an unlocking mode, said lock device having a fixed length when in the locking mode so as to prevent movement of the board relative to the latching assembly, and said lock device having an adjustable length when in the unlocking mode so as to permit movement of the board relative to the latching assembly.

16. The board assembly of claim 15 wherein the lock device is disposed on an exterior surface of the board.

17. The board assembly of claim 15 wherein the lock device is pivotally connected to the latching assembly.

18. The board assembly of claim 15 wherein the lock device is a gas-charged locking piston.

19. The board assembly of claim 15 wherein the lock device is a spring-loaded locking piston.

20. The board assembly of claim 15 wherein the lock device further comprises an actuating mechanism movable between a first position, wherein the actuating mechanism places the lock device in the unlocking mode, and a second position, wherein the actuating mechanism places the lock device in the locking mode.

21. The board assembly of claim 20 further comprising a grip connected to the actuating mechanism of the lock device, said grip being movable between a locking position, wherein the grip moves the actuating mechanism to the second position, and an unlocking position, wherein the grip moves the actuating mechanism to the first position.

22. The board assembly of claim 21 wherein the board defines a hand opening; and wherein the grip is disposed inside the board and is accessible through the hand opening.

* * * * *